US006699017B2

(12) United States Patent
Murase et al.

(10) Patent No.: US 6,699,017 B2
(45) Date of Patent: Mar. 2, 2004

(54) RESTRICTION STRUCTURE IN VARIABLE DISPLACEMENT COMPRESSOR

(75) Inventors: Masakazu Murase, Kariya (JP); Naoya Yokomachi, Kariya (JP); Tatsuya Koide, Kariya (JP)

(73) Assignee: Kabushiki Kaisha Toyota Jidoshokki, Kariya (JP)

( * ) Notice: Subject to any disclaimer, the term of this patent is extended or adjusted under 35 U.S.C. 154(b) by 19 days.

(21) Appl. No.: 10/195,023

(22) Filed: Jul. 12, 2002

(65) Prior Publication Data

US 2003/0021697 A1 Jan. 30, 2003

(30) Foreign Application Priority Data

Jul. 13, 2001 (JP) ..... 2001-213166

(51) Int. Cl.[7] ..... F04B 1/26; F04B 1/12; F01M 1/00

(52) U.S. Cl. ..... 417/222.2; 417/269; 417/270; 184/6.17

(58) Field of Search ..... 417/222.2, 270, 417/269; 184/6.17

(56) References Cited

U.S. PATENT DOCUMENTS

| | | | | |
|---|---|---|---|---|
| 3,712,759 A | * | 1/1973 | Olson, Jr. | 417/269 |
| 3,838,942 A | * | 10/1974 | Pokorny | 417/269 |
| 4,444,549 A | * | 4/1984 | Takahashi et al. | 417/269 |
| 4,963,074 A | * | 10/1990 | Sanuki et al. | 417/222.1 |
| 5,826,490 A | | 10/1998 | Madsen et al. | 92/71 |
| 6,192,699 B1 | * | 2/2001 | Kato et al. | 62/228.3 |
| 2002/0041809 A1 | | 4/2002 | Yokomachi, et al. | 417/222.2 |

FOREIGN PATENT DOCUMENTS

| | | | |
|---|---|---|---|
| DE | 36 15 459 A1 | 11/1986 | F04B/27/08 |
| EP | 0 283 963 A2 | 9/1988 | F04B/1/28 |
| EP | 0 952 343 A2 | 10/1999 | F04B/27/10 |
| EP | 0 980 973 A2 | 2/2000 | F04B/27/18 |
| JP | 2001-003860 | 1/2001 | F04B/27/10 |

* cited by examiner

*Primary Examiner*—Justine R. Yu
*Assistant Examiner*—Timothy P. Solak
(74) *Attorney, Agent, or Firm*—Morgan & Finnegan, LLP

(57) ABSTRACT

A seal is provided between the housing assembly of a variable displacement compressor and a rotary shaft to seal inside the housing assembly. The seal is retained in a retaining chamber, which is separated from a suction chamber and a control pressure chamber. A refrigerant passage is connected to the retaining chamber to feed a refrigerant to the retaining chamber to cause the refrigerant to contact the seal. The refrigerant passage includes a path extending from outside the housing assembly to the suction chamber through the retaining chamber. A restriction ring having a restriction function guides the refrigerant from the control pressure chamber to the retaining chamber and releases an internal pressure of the control pressure chamber.

8 Claims, 8 Drawing Sheets

RESTRICTION STRUCTURE IN VARIABLE DISPLACEMENT COMPRESSOR

BACKGROUND OF THE INVENTION

The present invention relates to a restriction structure in a variable displacement compressor.

In a conventional variable displacement compressor as disclosed in, for example, Japanese Unexamined Patent Publication No. 2001-3860, a low-pressure chamber is formed in a front head in order to improve the reliability of a shaft sealing unit arranged between the housing and the rotary shaft. The low-pressure chamber is shut off from a crank chamber by a first seal member. A second seal member which constitutes the shaft sealing unit is retained in the low-pressure chamber. Refrigerant that reaches the compressor from the outlet of an evaporator flows into the low-pressure chamber. Therefore, the suction pressure of the low-pressure chamber alone is applied to the second seal member, thereby reducing the load on the second seal member as compared with a case where the pressure in the crank chamber is applied to the second seal member.

The structure that uses a pair of seal members to define the low-pressure chamber increases the cost.

SUMMARY OF THE INVENTION

Accordingly, it is an objective of the present invention to ensure the high reliability of a shaft sealing unit located between the housing and the rotary shaft of a compressor to seal the housing while reducing the cost.

To achieve the foregoing and other objectives and in accordance with the purpose of the present invention, a variable displacement compressor having a housing assembly, a rotary shaft, a swash plate, pistons, seal means, a retaining chamber, a refrigerant passage, and a restricting member is provided. The housing assembly has a suction chamber, a discharge chamber, a control pressure chamber, and a cylinder block having a plurality of cylinder bores. The rotary shaft extends in the control pressure chamber and protrudes outside from the housing assembly. The rotary shaft is rotatably supported by the housing assembly. The swash plate is supported on the rotary shaft in a tiltable manner and rotatable together with the rotary shaft and is placed in the control pressure chamber. Pistons are retained in the cylinder bores and define compression chambers in the cylinder bores, so that as the pistons reciprocate in the respective cylinder bores based on rotation of the swash plate, a refrigerant is drawn into the compression chambers from the suction chamber, the refrigerant is discharged from the compression chambers to the discharge chamber. An inclination angle of the swash plate is changed by adjusting a pressure in the control pressure chamber. The seal means is provided between the housing assembly and the rotary shaft, for sealing inside the housing assembly. The retaining chamber retains the seal means. The retaining chamber is separated from the suction chamber and the control pressure chamber. The refrigerant passage extends from outside the housing assembly to the suction chamber through the retaining chamber. The refrigerant passage supplies the refrigerant to the seal means. The restricting member restricts the refrigerant from the control pressure chamber to the retaining chamber and releases an internal pressure of the control pressure chamber.

Other aspects and advantages of the invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which:

FIG. 2(*b*) is a cross-sectional view taken along line 2*b*—2*b* in FIG. 2(*a*);

FIG. 5(*b*) is a cross-sectional view taken along line 5*b*—5*b* in FIG. 5(*a*);

FIG. 6(*b*) is a cross-sectional view taken along line 6*b*—6*b* in FIG. 6(*a*);

FIG. 7(*b*) is a cross-sectional view taken along line 7*b*—7*b* in FIG. 7(*a*);

DETAILED DESCRIPTION OF THE PREFERRED EMBODIMENTS

A first embodiment of the present invention will be described below referring to FIGS. 1 to 4.

Figure 1:
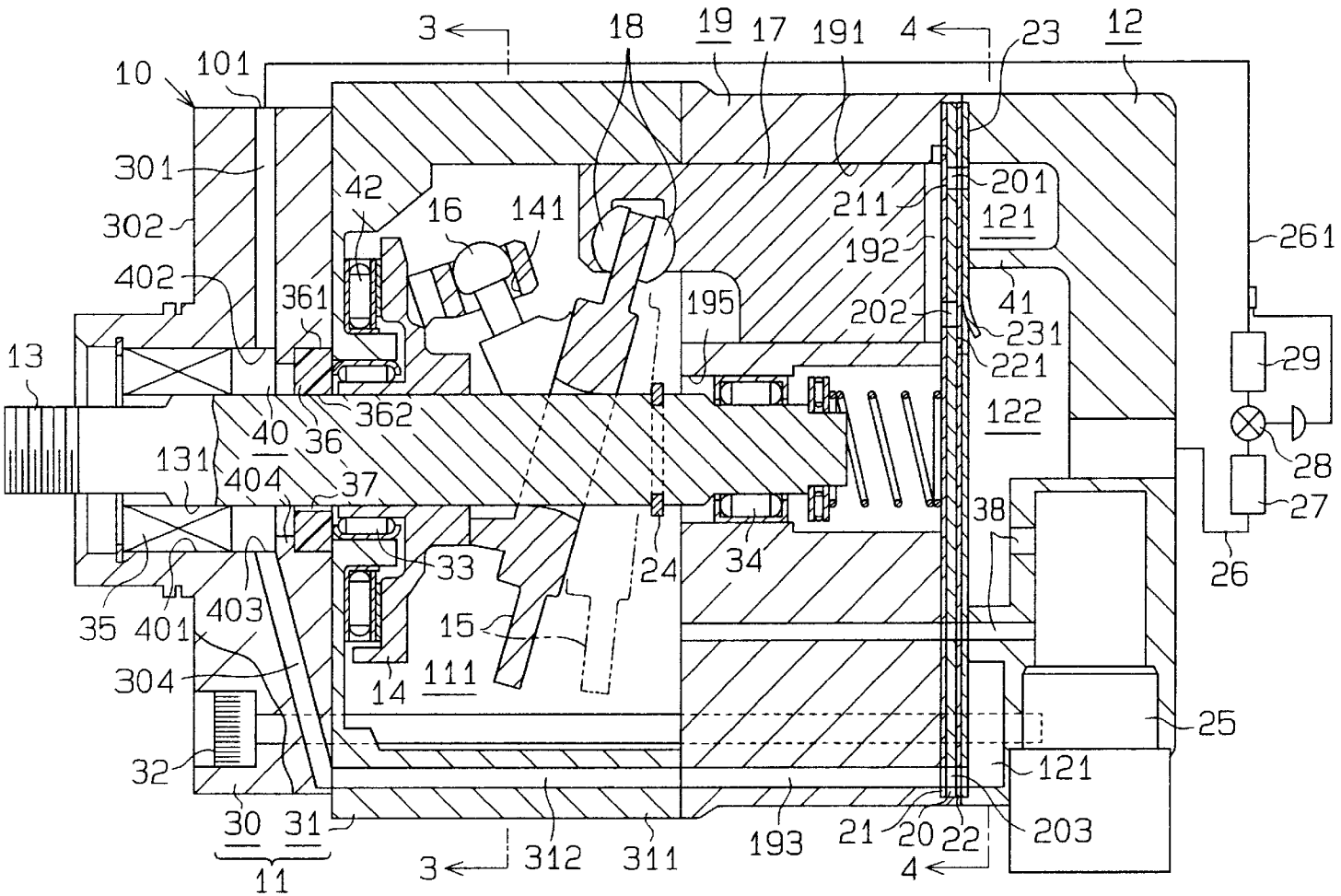
FIG. 1 is a side cross-sectional view of an entire compressor according to a first embodiment of the present invention.

FIG. 1 shows the internal structure of a variable displacement compressor. A housing assembly 10 of the compressor is constructed by connecting a front housing member 11, a rear housing member 12, and a cylinder block 19 together. The front housing member 11 comprises a supporting piece 30 and a chamber defining piece 31. The supporting piece 30, the chamber defining piece 31, the cylinder block 19 and the rear housing member 12 are secured by fastening bolts 32, which are screwed into the rear housing member 12 through the supporting piece 30, the chamber defining piece 31 and the cylinder block 19.

A rotary shaft 13 extends through the chamber defining piece 31 and the cylinder block 19, which define a control pressure chamber 111. A rotor 14 is fixed to the rotary shaft 13 in the control pressure chamber 111. A radial bearing 33 and a thrust bearing 42 are located between the rotor 14 and the chamber defining piece 31. A radial bearing 34 is located between the end portion of the rotary shaft 13 that is inserted in a support hole 195, formed in the cylinder block 19, and the surface of the support hole 195. The chamber defining piece 31 supports the rotor 14 and the rotary shaft 13 through the radial bearing 33 such that the rotor 14 and the rotary shaft 13 rotate integrally. The cylinder block 19 rotatably supports the rotary shaft 13 through the radial bearing 34.

The rotary shaft 13 protrudes outside the compressor via a through hole 40 in the supporting piece 30 and receives the rotational drive power from an external drive source, such as the engine of a vehicle. A mechanical seal 35 and a shut-off ring 36 are located in the through hole 40 apart from each other in the axial direction of the rotary shaft 13. The mechanical seal 35 serves as shaft sealing means intervened between the housing assembly 10 and the rotary shaft 13 in order to seal inside the housing assembly 10. The shut-off ring 36 is formed of a synthetic resin, such as polytetrafluoroethylene. The movement of the shut-off ring 36 toward the mechanical seal 35 from the radial bearing 33 is restricted by a flange 404 formed on an inner surface 401 of the through hole 40.

Figure 2A:
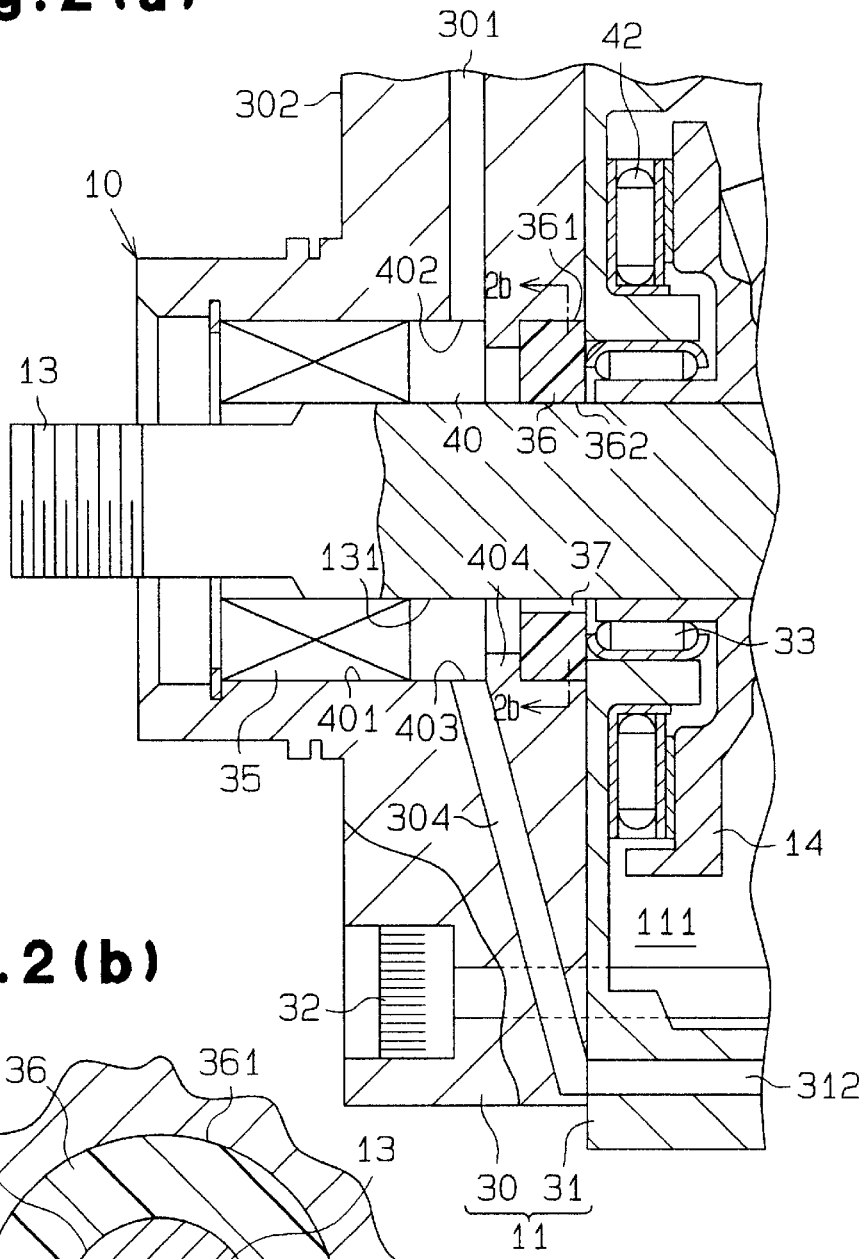
FIG. 2(*a*) is an enlarged side cross-sectional view of essential portions of the invention in FIG. 1.
Figure 2B:
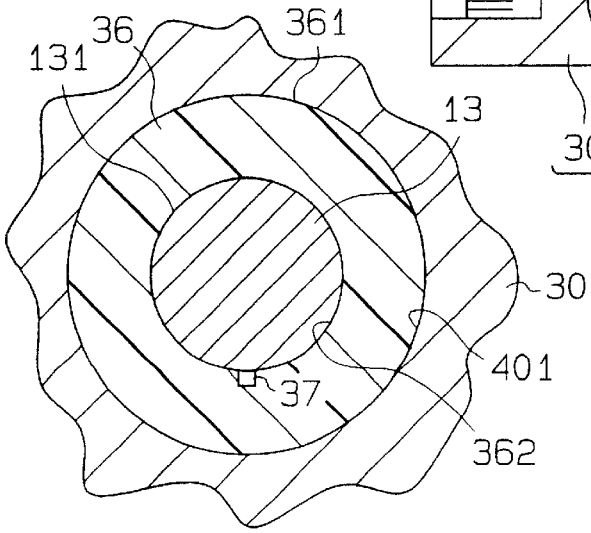
Figure 3:
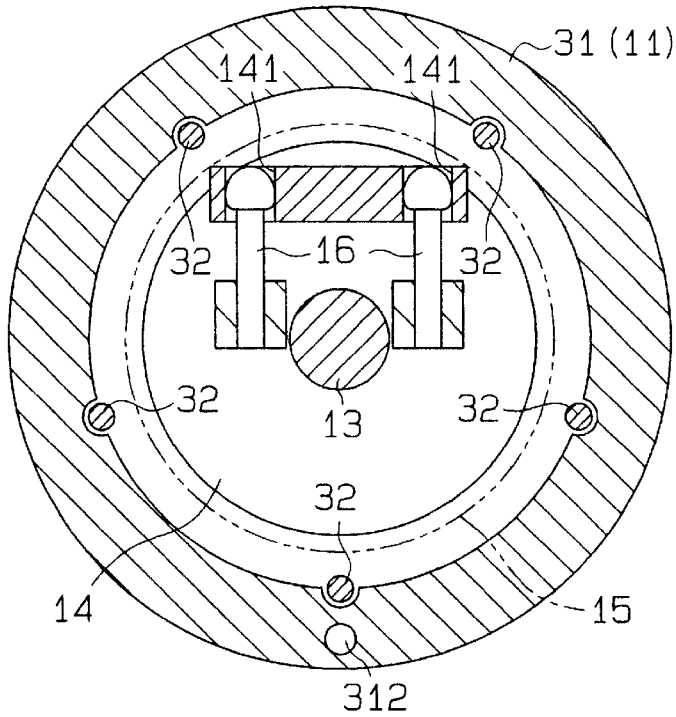
FIG. 3 is a cross-sectional view taken along line 3—3 in FIG. 1.

As shown in FIGS. 2(*a*) and 2(*b*), an outer surface 361 of the shut-off ring 36 is in close contact with the inner surface 401 of the through hole 40 in a slidable manner, and an inner surface 362 of the restriction ring 36 is in close contact with an outer surface 131 of the rotary shaft 13. As the rotary shaft 13 rotates, the restriction ring 36 slides on the outer surface 131 of the rotary shaft 13 or the inner surface 401 of the through hole 40 or both of the outer surface 131 of the rotary shaft 13 and the inner surface 401 of the through hole 40.

A restriction groove 37 is formed in the inner surface 362 of the restriction ring 36 in the axial direction of the rotary shaft 13. The restriction groove 37 communicates with the through hole 40, at the position between the mechanical seal 35 and the restriction ring 36, and the control pressure chamber 111. In other words, through hole 40 between the mechanical seal 35 and the restriction ring 36 communicates with the control pressure chamber 111 via the restriction groove 37 serving as a restriction passage. The restriction ring 36 connects the through hole 40 with the control pressure chamber 111 through a restricting groove 37. The through hole 40 becomes a retaining chamber of the mechanical seal 35 as the shaft sealing means. The restriction ring 36 and the restriction groove 37 constitute pressure release means which has a restriction function to release pressure into the retaining chamber from the control pressure chamber 111.

As shown in FIG. 1, a swash plate 15 is supported on the rotary shaft 13 to slide in the axial direction of the rotary shaft 13 and to tilt with respect to the rotary shaft 13. A pair of guide pins 16 (shown in FIG. 3) is fixed to the swash plate 15. The guide pins 16 are slidably fitted in guide holes 141 formed in the rotor 14. The engagement of the guide pins 16 with the guide holes 141 allows the swash plate 15 to be tiltable with respect to the rotary shaft 13 and rotatable together with the rotary shaft 13. The inclination of the swash plate 15 is guided by the guide holes 141, the guide pins 16, and the rotary shaft 13.

Figure 4:
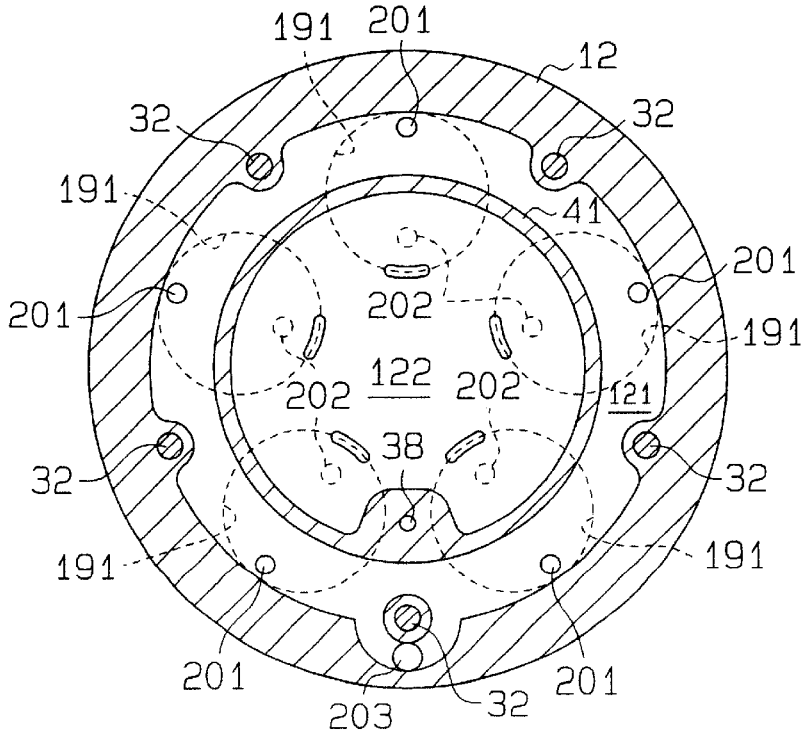
FIG. 4 is a cross-sectional view taken along line 4—4 in FIG. 1.

A plurality of cylinder bores 191 is formed in the cylinder block 19 at equal angular intervals around the rotary shaft 13. Although only one cylinder bore 191 is shown in FIG. 1, five cylinder bores 191 are provided according to the embodiment as shown in FIG. 4. A piston 17 is retained in each cylinder bore 191.

Each piston 17 defines a compression chamber 192 in the associated cylinder bore 191. The rotational motion of the swash plate 15 is converted to the forward and backward reciprocating motion of the associated piston 17 via shoes 18 so that the piston 17 moves forward and backward in the cylinder bore 191.

A first plate 20, a second plate 21, a third plate 22, and a fourth plate 23 are intervened between the cylinder block 19 and the rear housing member 12 to form a valve plate assembly. A suction chamber 121 and a discharge chamber 122 are defined in the rear housing member 12. A partition 41 separates the suction chamber 121 from the discharge chamber 122 which is surrounded by the suction chamber 121.

The motion of the piston 17 (the leftward movement from the right-hand side in FIG. 1) causes a refrigerant in the suction chamber 121, which is a suction pressure zone, to push a suction valve 211 on the second plate 21 away from a suction port 201 in the first plate 20 and flow into the compression chambers 192. The motion of the piston 17 (the rightward movement from the left-hand side in FIG. 1) causes the refrigerant flowed into the compression chambers 192 to push a discharge valve 221 on the third plate 22 away from a discharge suction port 202 in the first plate 20 and flow into the discharge chamber 122, which is a discharge pressure zone. As the discharge valve 221 abuts on a retainer 231 on the fourth plate 23, its degree of opening is restricted. The compression reactive force that acts on each piston 17 at the time of discharging the refrigerant to the discharge chamber 122 from each compression chamber 192, is received at an end wall of the chamber defining piece 31 via the shoes 18, the swash plate 15, the guide pins 16, the rotor 14, and the thrust bearing 42.

A pressure supply passage 38, which connects the discharge chamber 122 to the control pressure chamber 111, feeds the refrigerant in the discharge chamber 122 to the control pressure chamber 111. The refrigerant in the control pressure chamber 111 flows to the through hole 40 through the thrust bearing 42, a clearance in the radial bearing 33, and the restriction groove 37. That is, the pressure in the control pressure chamber 111 is released into the through hole 40 via the restriction groove 37.

An electromagnetic displacement control valve 25 is intervened in the pressure supply passage 38. The displacement control valve 25 is excited and de-excited by a controller (not shown). The controller excites and de-excites the displacement control valve 25 based on a detected room temperature acquired by a room temperature detector (not shown), which detects the room temperature in a vehicle, and a target temperature, which has been set by a room temperature setting unit (not shown). The displacement control valve 25 is open in a de-energized state and is closed in an energized state. That is, the refrigerant in the discharge chamber 122 is fed to the control pressure chamber 111 when the displacement control valve 25 is de-excited, while the refrigerant in the discharge chamber 122 is not fed to the control pressure chamber 111 when the displacement control valve 25 is excited. The displacement control valve 25 controls the supply of the refrigerant to the control pressure chamber 111 from the discharge chamber 122.

The inclination angle of the swash plate 15 is changed by the control of the pressure in the control pressure chamber 111. The inclination angle of the swash plate 15 becomes smaller as the pressure in the control pressure chamber 111 increases, whereas the inclination angle of the swash plate 15 becomes larger as the pressure in the control pressure chamber 111 decreases. The pressure in the control pressure chamber 111 rises as the refrigerant is supplied to the control pressure chamber 111 from the discharge chamber 122, whereas the pressure in the control pressure chamber 111 falls as the supply of the refrigerant to the control pressure chamber 111 from the discharge chamber 122 is stopped. That is, the inclination angle of the swash plate 15 is controlled by the displacement control valve 25.

The maximum inclination angle of the swash plate 15 is defined by the abutment of the swash plate 15 against the rotor 14. The minimum inclination angle of the swash plate 15 is defined by the abutment of a snap ring 24 on the rotary shaft 13 against the swash plate 15.

As shown in FIG. 2(*a*), suction passages 301 and 304 are formed in the supporting piece 30 to communicate with the through hole 40. An inlet 101 of the suction passage 301 in the housing assembly 10 is provided in the outer surface of the supporting piece 30 at the topmost position. An inlet port 402 of the suction passage 301 opens to the through hole 40 and is provided at the topmost position in the inner surface 401 of the through hole 40. An outlet port 403 of the suction passage 304 opens to the through hole 40, and is provided at the lowermost position in the inner surface 401 of the through hole 40. That is, the inlet port 402 is located directly above the rotary shaft 13, and the outlet port 403 directly below the rotary shaft 13.

As shown in FIG. 1, suction passages 312 and 193 are formed in the vicinity of the lowermost position of a peripheral wall 311 of the chamber defining piece 31 and in the vicinity of the lowermost position of the cylinder block 19. The suction passage 312 communicates with the suction passage 304 at the junction of the supporting piece 30 and the chamber defining piece 31, and communicates with the suction passage 193 at the junction of the chamber defining piece 31 and the cylinder block 19.

A through hole 203 is formed in the vicinity of the lowermost positions of the first plate 20, the second and third plates 21 and 22, and the fourth plate 23. The through hole 203 communicates with the suction passage 193 and the suction chamber 121. The suction passage 301 constitutes a refrigerant passage upstream of the through hole 40, while the suction passages 304, 312 and 193 and the through hole 203 constitute a refrigerant passage downstream of the through hole 40.

The discharge chamber 122 and the suction chamber 121 are connected via an external refrigerant circuit 26, the suction passage 301, the through hole 40, the suction passages 304, 312 and 193 and the through hole 203. The refrigerant that has flowed to the external refrigerant circuit 26 from the discharge chamber 122 passes through a condenser 27, an expansion valve 28 and an evaporator 29 and returns to the suction chamber 121 through the suction passage 301, the through hole 40, the suction passages 304, 312 and 193 and the through hole 203.

The first embodiment has the following advantages.

(1-1) A passage 261 (shown in FIG. 1), which is part of the external refrigerant circuit 26 and which extends to the inlet 101 of the suction passage 301 from the evaporator 29, is the suction pressure zone outside the compressor. The temperature of the refrigerant that has undergone heat exchange in the evaporator 29 has become low and the refrigerant that has flowed to the suction passage 301 from the external refrigerant circuit 26 passes through the through hole 40 and flows to the suction chamber 121 via the suction passages 304, 312 and 193. The pressure in the through hole 40 is low, a level equivalent to the suction pressure. Therefore, the load on the mechanical seal 35 is reduced as compared with the case where the pressure in the control pressure chamber 111 is applied to the mechanical seal 35.

The refrigerant that passes the through hole 40 cools the mechanical seal 35 directly or indirectly. Part of the lubrication oil of a low temperature that flows together with the refrigerant sticks on the mechanical seal 35 to lubricate and cool down the mechanical seal 35. Part of the low-temperature lubrication oil contacts the outer surface of the rotary shaft 13 to cool down the part of the rotary shaft 13 near the through hole 40. Therefore, the mechanical seal 35 is efficiently cooled down. The reduction in load on the mechanical seal 35 and the efficient cooling of the mechanical seal 35 improves the reliability of the mechanical seal 35.

The pressure in the control pressure chamber 111 is adjusted by the pressure release via the restriction groove 37 of the restriction ring 36 as the pressure release means. The restriction groove 37 connects the interior of the through hole 40 between the mechanical seal 35 and the restriction ring 36 with the control pressure chamber 111 through a restriction passage. Therefore, the interior of the through hole 40 between the mechanical seal 35 and the restriction ring 36 is kept as the suction pressure zone.

The shaft sealing means demands reliable prevention of refrigerant leakage. However, the shaft sealing means need not have very high capabilities of preventing refrigerant leakage from between the inner surface 362 of the restriction ring 36 and the outer surface 131 of the rotary shaft 13 to leak the refrigerant to the through hole 40 from the control pressure chamber 111 and preventing refrigerant leakage from between the outer surface 361 of the restriction ring 36 and the inner surface 401 of the through hole 40. The restriction ring 36 has only to be fittable over the rotary shaft 13 and in the through hole 40 to be slidable on the outer surface 131 of the rotary shaft 13 and the inner surface 401 of the through hole 40. That is, the size precision of the restriction ring 36 can be low.

The restriction ring 36 can be produced cheaper and easier than the shaft sealing means. The use of the restriction ring 36 is advantageous in cost over the conventional compressor disclosed in Japanese Unexamined Patent Publication No. 2001-3860, which uses the shaft sealing means.

(1-2) The restriction groove 37 is formed in the inner surface 362 of the restriction ring 36. The inner surface 362 of the restriction ring 36 is a portion where the groove can be formed easily. The inner surface 362 of the restriction ring 36 is therefore suitable as the portion where the restriction groove 37 is to be formed.

(1-3) The restriction ring 36 is molded of a synthetic resin. Because of a low degree of precision being sufficient for the restriction ring 36, processing after the molding is unnecessary. Even if the outside diameter of the restriction ring 36 is set slightly larger than the diameter of the through hole 40, particularly, the resilient deformation of the synthetic resin allows the restriction ring 36 to be fittable in the through hole 40. Even if the inside diameter of the restriction ring 36 is set smaller than the diameter of the rotary shaft 13, the resilient deformation of the synthetic resin allows the restriction ring 36 to be fittable over the rotary shaft 13. Therefore, the resin restriction ring 36 is particularly easy to produce.

(1-4) The synthetic resin has a better slidability than metal and is thus suitable as the material for the restriction ring 36. In particular, polytetrafluoroethylene, which has the best slidability, is most suitable as the material for the restriction ring 36.

(1-5) Since the inlet port 402 and the outlet port 403 of the through hole 40 are formed apart from each other, the refrigerant flows smoothly in the through hole 40. Therefore, the low-temperature lubrication oil which flows together with the refrigerant in the through hole 40 flows satisfactorily so that the mechanical seal 35 or the shaft sealing means retained in the through hole 40 is cooled efficiently.

(1-6) Part of the lubrication oil that has flowed into the through hole 40 from the inlet port 402 located directly above the rotary shaft 13 travels along the mechanical seal 35 and cools down the mechanical seal 35 while moving downward. The lubrication oil flows out from the outlet port 403 located directly under the rotary shaft 13. Because the inlet port 402 and the outlet port 403 are respectively arranged above and below the rotary shaft 13, the lubrication oil that travels along the mechanical seal 35 drops due to its own weight. This port arrangement contributes to the nice flow of the lubrication oil in the through hole 40.

(1-7) The refrigerant in the control pressure chamber 111 flows out of the through hole 40 through the clearance in the thrust bearing 42, the clearance in the radial bearing 33, and the restriction groove 37. Therefore, the lubrication oil that flows together with the refrigerant, which moves to the through hole 40 from the control pressure chamber 111, lubricates the thrust bearing 42 and the radial bearing 33, thereby improving the reliability of the thrust bearing 42 and the radial bearing 33. The clearance in the thrust bearing 42 and the clearance in the radial bearing 33 are part of the refrigerant passage that extends to the through hole 40 from the control pressure chamber 111 via the restriction groove 37. This passage structure improves the reliability of the thrust bearing 42 and the radial bearing 33.

(1-8) The suction passages 301 and 304 pass through the wall of the front housing member 11 that supports the mechanical seal 35, and the inlet 101 of the suction passage 301 in the housing assembly 10 is provided in the outer surface of the front housing member 11. The shorter the suction passage 301 extending to the through hole 40 from the external refrigerant circuit 26 is, the more the temperature rise of the lubrication oil in the path that extends from the external refrigerant circuit 26 to the through hole 40 through the suction passage 301 is suppressed. The structure that has the inlet 101 provided in the outer surface of the front housing member 11 is preferable, as it shortens the length of the suction passage 301 that extends to the through hole 40 from the passage 261, which is the external suction pressure zone of the housing assembly 10.

(1-9) The space in the vicinity of an outer end face 302 (see FIG. 1) of the supporting piece 30 is where there is part of the power transmission mechanism (e.g., an electromagnetic clutch) for transmitting power to the rotary shaft 13 from the external drive source. It is therefore difficult to provide the inlet 101 of the suction passage 301 in the outer end face 302. The outer surface of the supporting piece 30, particularly the portion of that outer surface which lies directly above the rotary shaft 13, is suitable as the portion where the inlet 101 is provided.

Figure 5A:
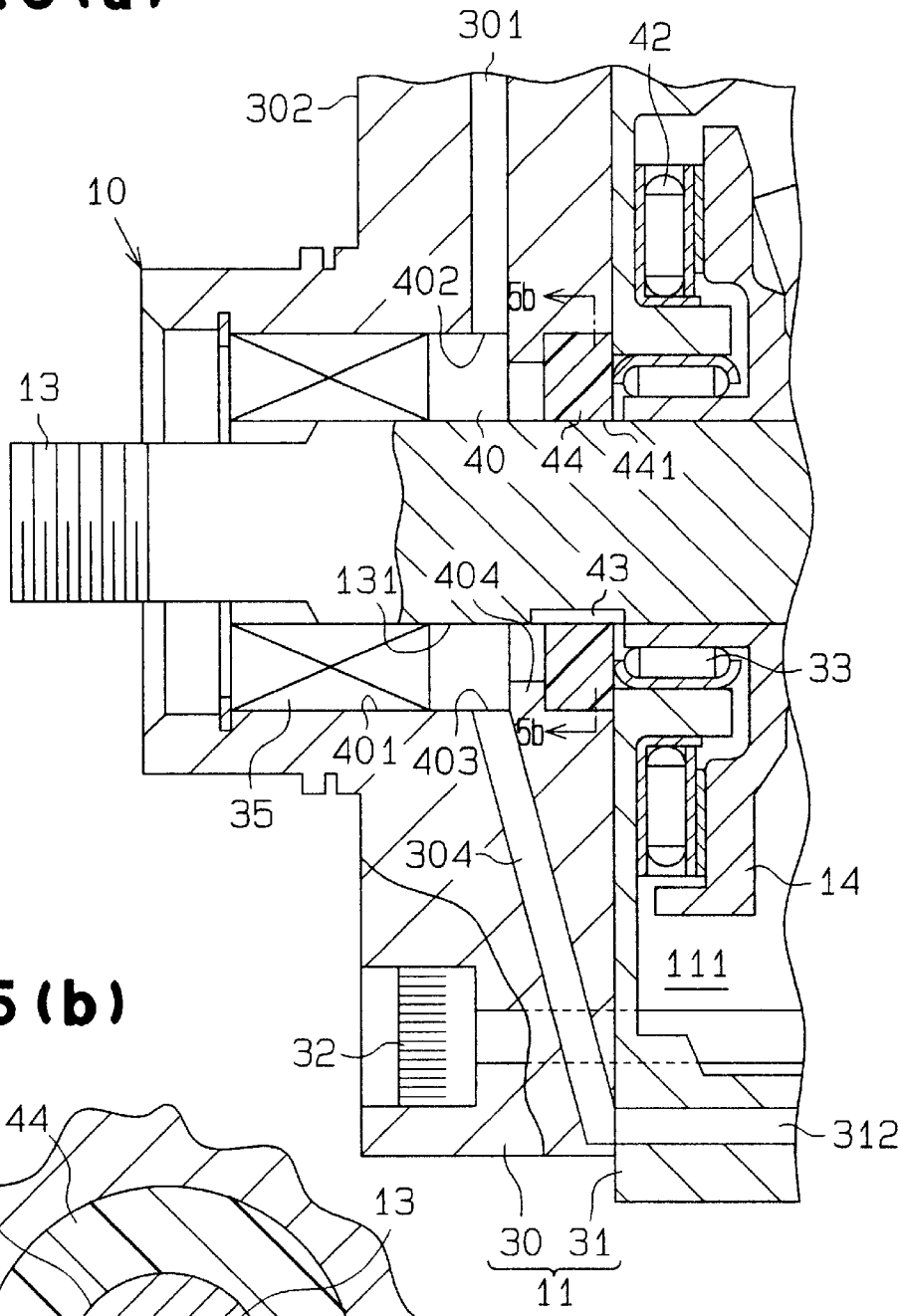
FIG. 5(*a*) is an enlarged side cross-sectional view of essential portions of a compressor according to a second embodiment of the present invention.
Figure 5B:
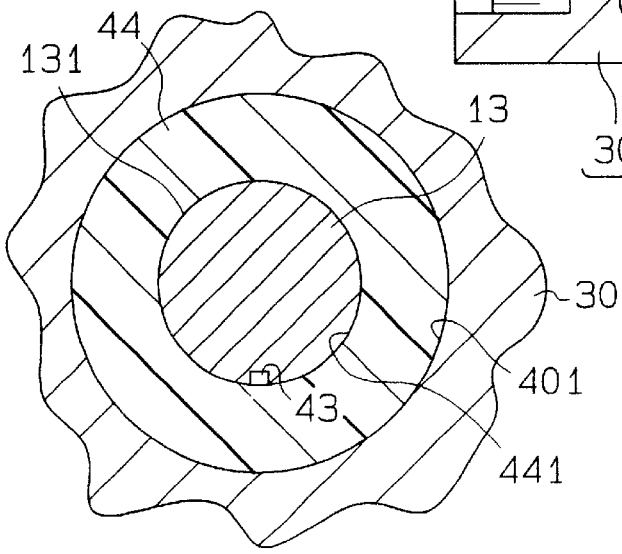

A second embodiment shown in FIGS. 5(*a*) and 5(*b*) will be discussed below. Same reference symbols are used for those components which are the same as the corresponding components of the first embodiment.

A restriction groove 43 is formed in the outer surface 131 of the rotary shaft 13 between the radial bearing 33 and the flange 404 in the axial direction of the rotary shaft 13. A restriction ring 44 of a synthetic resin is fitted about the rotary shaft 13 and in the through hole 40. The length (thickness) of the restriction ring 44 is smaller than the length of the restriction groove 43 as a restriction passage. Both end portions of the restriction groove 43 are off an inner surface 441 of the restriction ring 44. Part of the through hole 40 between the restriction ring 44 and the mechanical seal 35 communicates with the control pressure chamber 111 via the restriction groove 43. The refrigerant in the control pressure chamber 111 flows to the through hole 40 via the restriction groove 43. The restriction ring 44 and the restriction groove 43 constitute the pressure release means.

The second embodiment has the same advantages as the advantages (1-1) and (1-3) to (1-9) of the first embodiment. The outer surface 131 of the rotary shaft 13 is suitable as the portion where the restriction passage is to be formed.

Figure 6A:
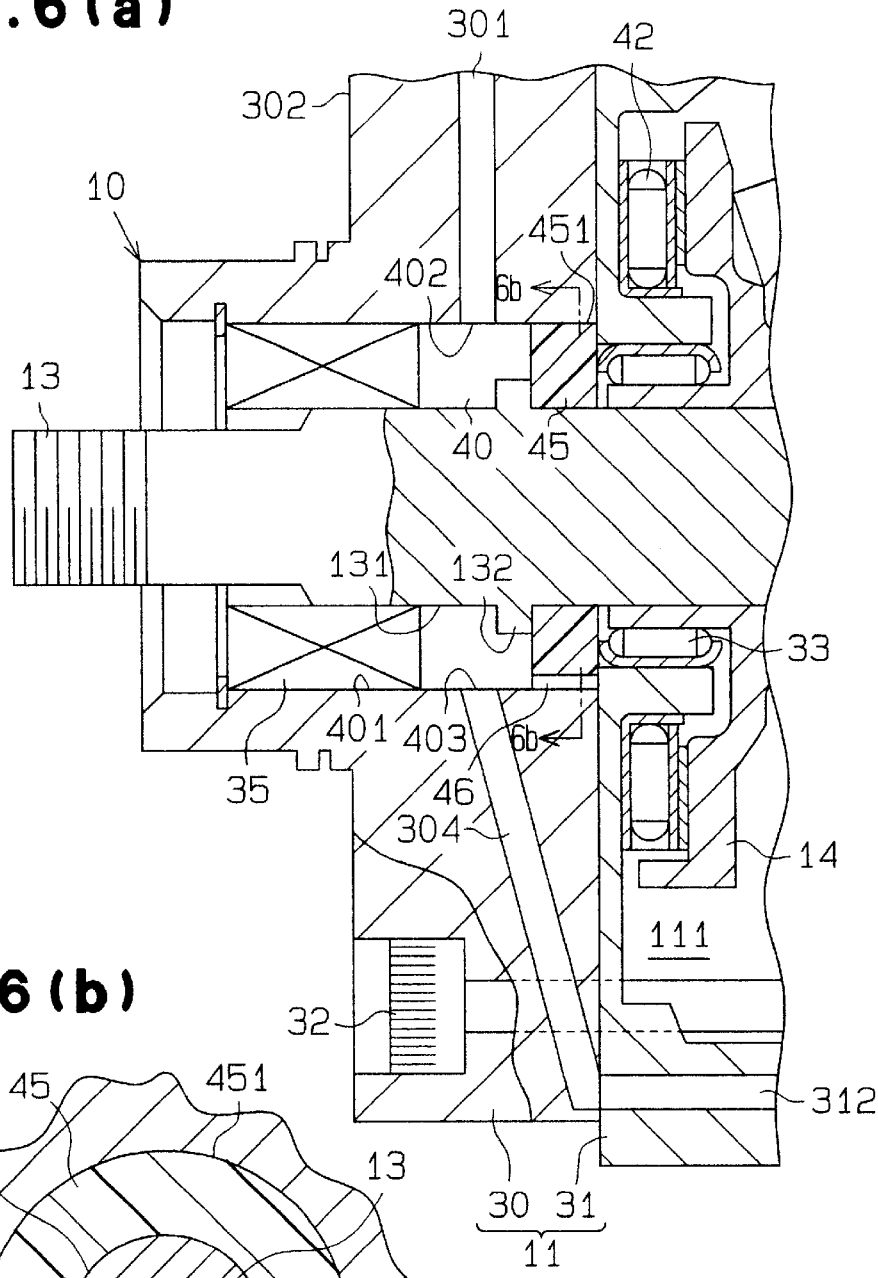
FIG. 6(*a*) is an enlarged side cross-sectional view of essential portions of a compressor according to a third embodiment of the present invention.
Figure 6B:
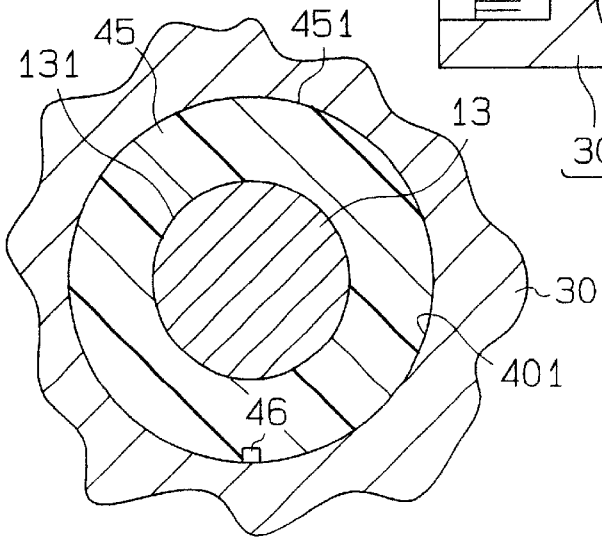

A third embodiment shown in FIGS. 6(*a*) and 6(*b*) will be discussed below. Same reference symbols are used for those components which are the same as the corresponding components of the first embodiment.

A restriction ring 45 of a synthetic resin is fitted about the rotary shaft 13 and in the through hole 40. The movement of the restriction ring 45 toward the mechanical seal 35 from the radial bearing 33 is restricted by a flange 132 formed on the outer surface 131 of the rotary shaft 13. A restriction groove 46 is formed in an outer surface 451 of the restriction ring 45 in the axial direction of the rotary shaft 13. The restriction groove 46 communicates with the through hole 40 between the mechanical seal 35 and the restriction ring 45 and with the control pressure chamber 111. The through hole 40 between the mechanical seal 35 and the restriction ring 45 communicates with the control pressure chamber 111 via the restriction groove 46 as a restriction passage. The restriction ring 45 and the restriction groove 46 constitute the pressure release means.

The third embodiment has the same advantages as the advantages (1-1) and (1-3) to (1-9) of the first embodiment.

The restriction groove 46 is formed in the outer surface 451 of the restriction ring 45. The outer surface 451 of the restriction ring 45 is where the groove can be formed easily. Therefore, the outer surface 451 of the restriction ring 45 is suitable as the portion where the restriction passage is to be formed.

Figure 7A:
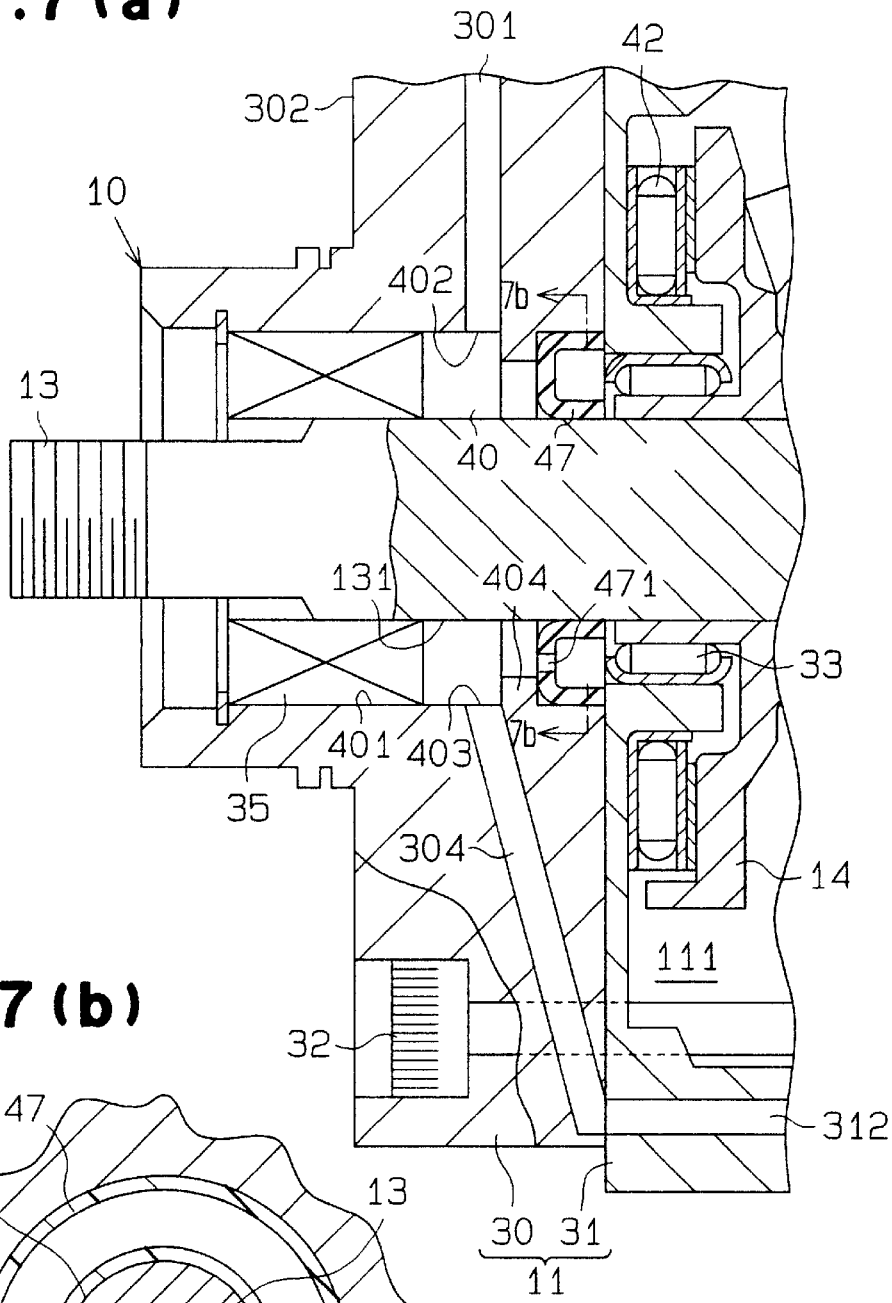
FIG. 7(*a*) is an enlarged side cross-sectional view of essential portions of a compressor according to a fourth embodiment of the present invention.
Figure 7B:
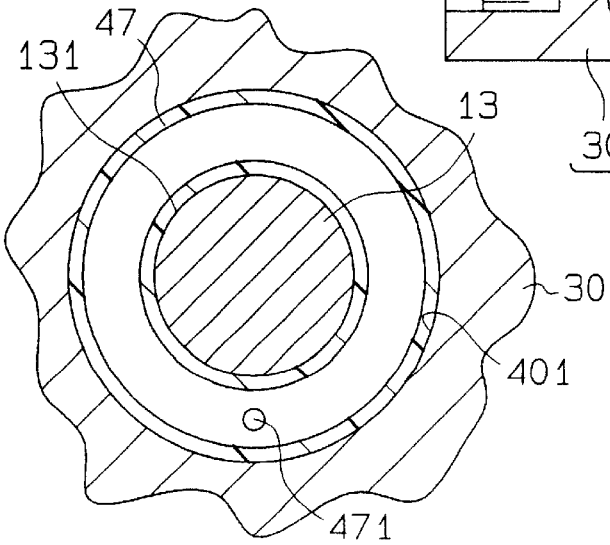

A fourth embodiment shown in FIGS. 7(*a*) and 7(*b*) will be discussed below. Same reference symbols are used for those components which are the same as the corresponding components of the first embodiment.

A rubber restriction ring 47 has a U-shaped cross section and has a restriction hole 471 formed in the center of the bottom portion. The pressure on that side of the control pressure chamber 111 causes the restriction ring 47 to closely contact the outer surface 131 of the rotary shaft 13 and the inner surface 401 of the through hole 40. The restriction hole 471 as a restriction passage and the restriction ring 47 constitute the pressure release means.

The fourth embodiment has the same advantages as the advantages (1-1) and (1-5) to (1-9) of the first embodiment.

Although the rubber restriction ring 47 is molded, the resilient deformation of the rubber permits a lower size precision than that in the case of the restriction ring of a synthetic resin. This makes the rubber restriction ring 47 easier to produce than the restriction ring of a synthetic resin.

Figure 8:
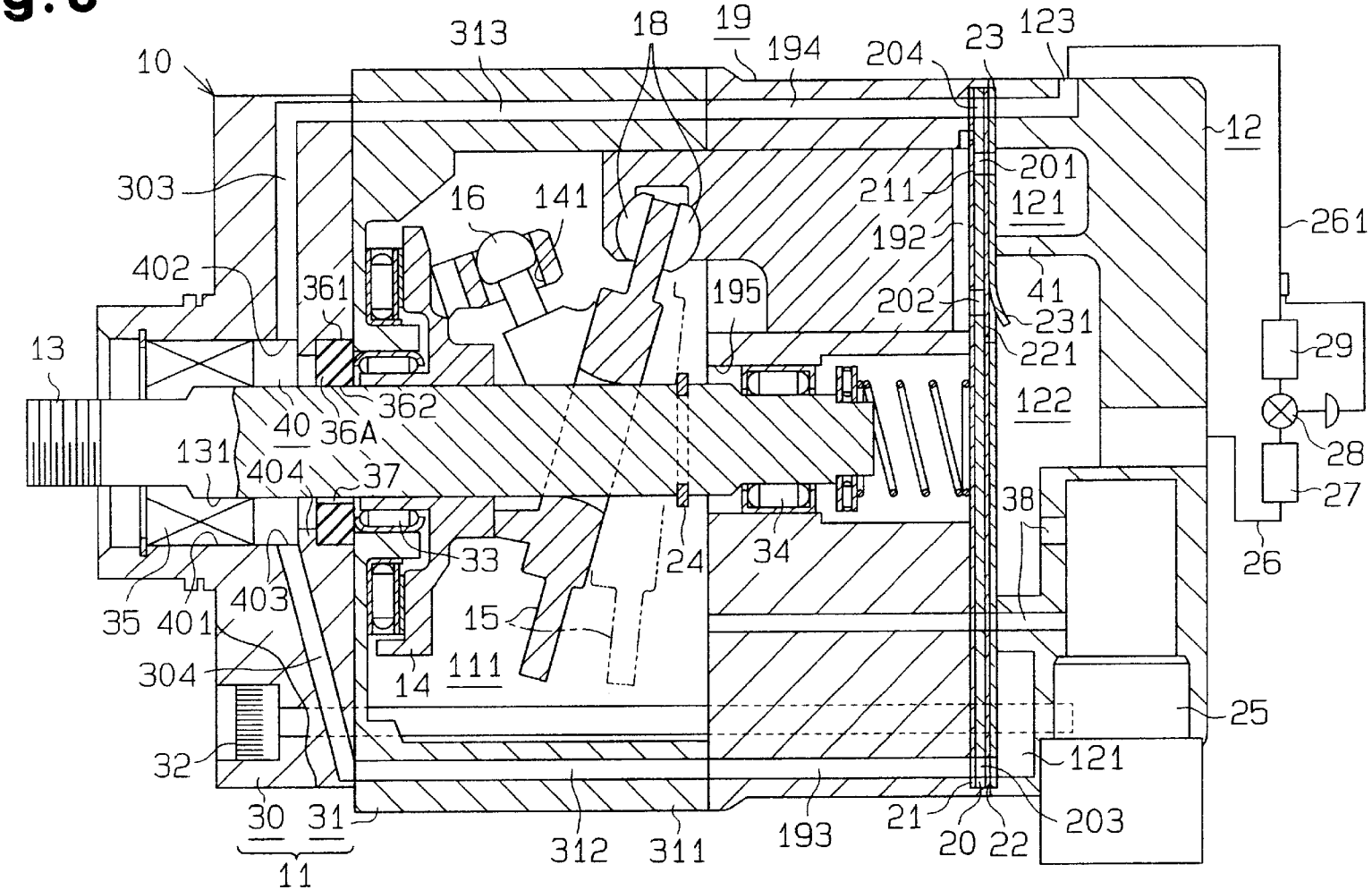
FIG. 8 is a side cross-sectional view showing a compressor according to a fifth embodiment of the present invention.

A fifth embodiment shown in FIG. 8 will be discussed below. Same reference symbols are used for those components which are the same as the corresponding components of the first embodiment.

An inlet passage 123 is formed in the rear housing member 12. The inlet passage 123 communicates with the passage 261. A through hole 204 is formed in the first plate 20, the second and third plates 21 and 22, and the fourth plate 23 to communicate with the inlet passage 123. Suction passages 194 and 313 are formed in the vicinity of the topmost positions of the outer portion of the cylinder block 19 and the peripheral wall 311 of the chamber defining piece 31. The suction passage 194 communicates with the through hole 204, and the suction passages 194 and 313 communicate with each other at the junction of the chamber defining piece 31 and the cylinder block 19. A suction passage 303 in the supporting piece 30 communicates with the suction passage 313 and the through hole 40. The inlet passage 123, the through hole 204, and the suction passages 194, 313 and 303 constitute a refrigerant passage upstream the through hole 40. The suction passages 304, 312 and 193 and the through hole 203 constitute a refrigerant passage downstream the through hole 40. A restriction ring 36A is formed of a rubber.

The fifth embodiment has the same advantages as the advantages (1-1), (1-2) and (1-5) to (1-9) of the first embodiment.

A sixth embodiment shown in FIGS. 9 and 10 will be discussed below. Same reference symbols are used for those components which are the same as the corresponding components of the fifth embodiment.

Figure 10:
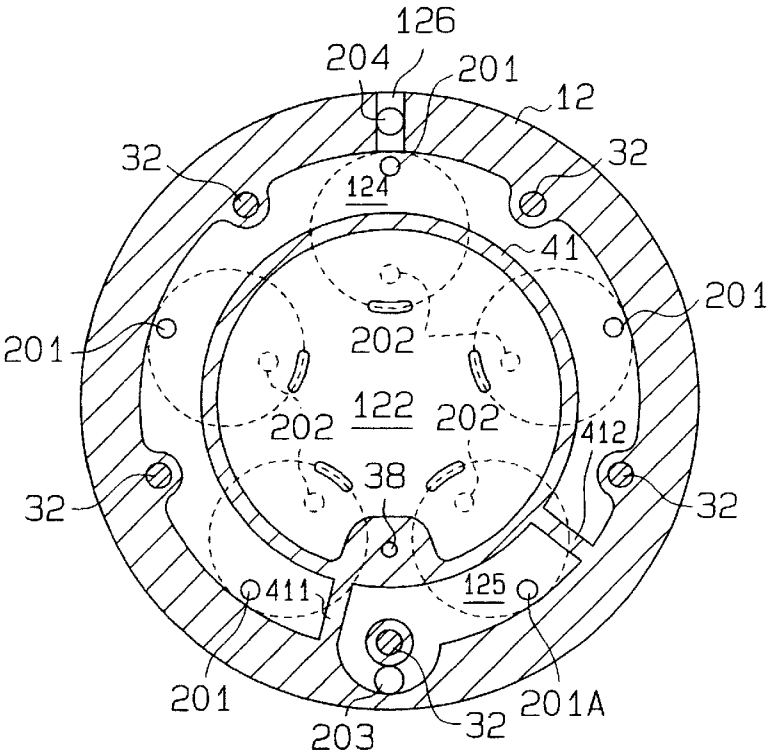
FIG. 10 is a cross-sectional view taken along line 10—10 in FIG. 9.

As shown in FIG. 10, a first suction chamber 124 and a second suction chamber 125 are defined in the rear housing member 12 by partitions 41, 411 and 412. The second suction chamber 125 communicates only with a specific one suction port 201A in a plurality of suction ports 201. The first suction chamber 124 communicates with the other suction ports 201 than the suction port 201A.

Figure 9:
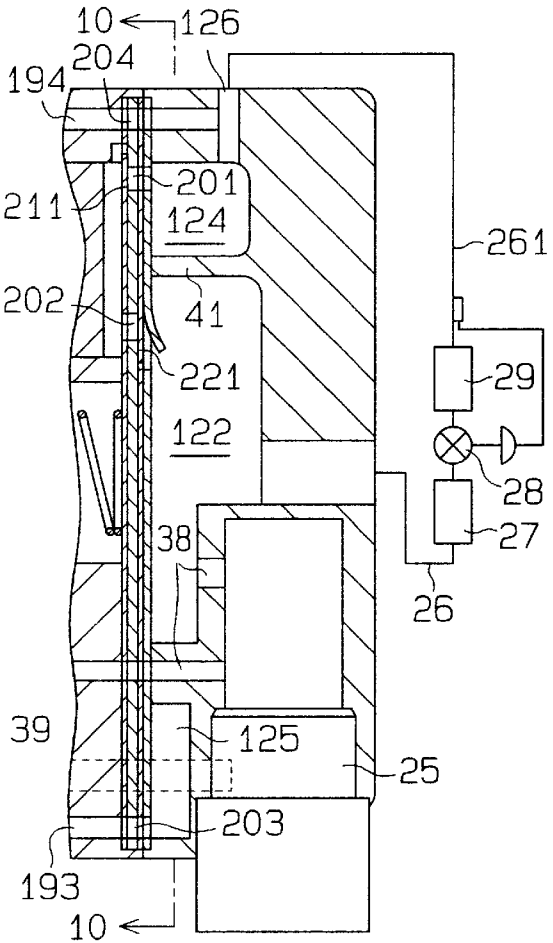
FIG. 9 is a side cross-sectional view of essential portions showing a compressor according to a sixth embodiment of the present invention.

As shown in FIG. 9, the first suction chamber 124 is connected to the external refrigerant circuit 26 via an inlet passage 126 formed in the rear housing member 12. The suction passage 194 communicates with the inlet passage 126 via the through hole 204, and the suction passage 193 communicates with the second suction chamber 125 via the through hole 203. The refrigerant that has passed the evaporator 29 flows into the first suction chamber 124 and the suction passage 194 via the inlet passage 126. The refrigerant that has flowed into the suction passage 194 flows to the suction port 201A via the suction passages 313, 303, 304, 312 and 193.

The sixth embodiment has the same advantages as the advantages of the fifth embodiment. Because the refrigerant flowing through the suction passages 194, 313, 303, 304, 312 and 193 is drawn into only one of a plurality of compression chambers 192, the flow rate of the refrigerant in the suction passages 194, 313, 303, 304, 312 and 193 becomes lower than that in the fifth embodiment. It is therefore possible to make the diameters of the suction passages 194, 313, 303, 304, 312 and 193 smaller than those in the fifth embodiment. As a result, the peripheral wall 311 through which the suction passages 313 and 312 pass can be made thinner than that in the fifth embodiment, so that the compressor becomes lighter than the compressor of the fifth embodiment.

It should be apparent to those skilled in the art that the present invention may be embodied in many other specific forms without departing from the spirit or scope of the invention. Particularly, it should be understood that the invention may be embodied in the following forms.

(1) The restriction ring 36 may be formed of a metal.

(2) A lip seal may be used as the shaft sealing means.

(3) The supporting piece 30 may be formed integral with the chamber defining piece 31.

(4) In each of the embodiments, the direction of the suction passage may be drastically changed before the inlet port 402 of the suction passage.

The rapid change in the passage direction before the inlet port 402 separates the lubrication oil from the refrigerant, thus increasing the amount of the lubrication oil that directly contacts the mechanical seal 35 or the surface of the rotary shaft 13 in the through hole 40. In this case, the efficiency of cooling the mechanical seal 35 is improved.

Therefore, the present examples and embodiments are to be considered as illustrative and not restrictive and the invention is not to be limited to the details given herein, but may be modified within the scope and equivalence of the appended claims.

What is claimed is:

1. A variable displacement compressor comprising:

a housing assembly having a suction chamber, a discharge chamber, a control pressure chamber, and a cylinder block having a plurality of cylinder bores;

a rotary shaft extending in said control pressure chamber and protruding outside from said housing assembly, said rotary shaft being rotatably supported by the housing assembly;

a swash plate, supported on said rotary shaft in a tiltable manner and rotatable together with said rotary shaft and placed in said control pressure chamber;

wherein an inclination angle of said swash plate is changed by adjusting a pressure in said control pressure chamber;

pistons respectively retained in said cylinder bores and defining compression chambers in said cylinder bores, so that as said pistons reciprocate in the respective cylinder bores based on rotation of said swash plate, a refrigerant is drawn into said compression chambers from said suction chamber, said refrigerant is discharged from said compression chambers to the discharge chamber;

seal means, provided between said housing assembly and said rotary shaft, for sealing inside said housing assembly;

a retaining chamber retaining said seal means, wherein the retaining chamber is separated from said suction chamber and said control pressure chamber;

a refrigerant passage extending from outside said housing assembly to said suction chamber through said retaining chamber, wherein the refrigerant passage supplies said refrigerant to said seal means; and a restricting member restricting said refrigerant from said control pressure chamber to said retaining chamber and releasing an internal pressure of said control pressure chamber.

2. The variable displacement compressor according to claim 1, wherein said restricting member includes a restriction ring fitted about said rotary shaft to connect said retaining chamber to said control pressure chamber through a restriction passage.

3. The variable displacement compressor according to claim 2, wherein said restriction passage is a restriction groove formed in an inner surface or outer surface of said restriction ring.

4. The variable displacement compressor according to claim 2, wherein said restriction passage is a restriction groove formed in an outer surface of said rotary shaft.

5. The variable displacement compressor according to claim 2, wherein said restriction ring is formed of a resin or rubber.

6. The variable displacement compressor according to claim 1, wherein the refrigerant passage includes a first passage section and a second passage section, the first passage section extending from the exterior of the compressor to the retaining chamber through the housing assembly, and the second passage section extending from the retaining chamber to the suction chamber through the housing assembly, wherein an inlet port connecting the first passage section to the retaining chamber is formed separately from an outlet port connecting the retaining chamber to the second passage section, and wherein the inlet port is located above the rotary shaft, and the outlet port is located below the rotary shaft.

7. The variable displacement compressor according to claim 1, further comprising a radial bearing supporting said rotary shaft, wherein the radial bearing is separated from said retaining chamber by said restriction ring, and said refrigerant in said control pressure chamber flows to said retaining chamber through said radial bearing and said restriction ring.

8. The variable displacement compressor according to claim 1, wherein the seal means is located outside the restricting member.

* * * * *